US008479660B2

(12) United States Patent
Brandt

(10) Patent No.: US 8,479,660 B2
(45) Date of Patent: Jul. 9, 2013

(54) AUTOMATED RAILCAR GATE OPERATING SYSTEM

(75) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 168 days.

(21) Appl. No.: 13/115,286

(22) Filed: May 25, 2011

(65) Prior Publication Data

US 2011/0219981 A1 Sep. 15, 2011

Related U.S. Application Data

(63) Continuation-in-part of application No. 12/696,229, filed on Jan. 29, 2010, now Pat. No. 8,250,991.

(51) Int. Cl.
*B61D 9/14* (2006.01)

(52) U.S. Cl.
USPC ..... 105/241.2

(58) Field of Classification Search
USPC 105/238.1, 241.1, 241.2, 286–288; 73/865.8, 73/865.9, 866.1
See application file for complete search history.

(56) References Cited

U.S. PATENT DOCUMENTS

| | | | | |
|---|---|---|---|---|
| 7,063,022 | B1 | 6/2006 | Marchiori et al. | |
| 7,178,465 | B1 * | 2/2007 | Marchiori et al. | 105/241.2 |
| 7,328,871 | B2 * | 2/2008 | Mace et al. | 246/169 R |
| 7,377,219 | B2 | 5/2008 | Brandt | |

* cited by examiner

*Primary Examiner* — R. J. McCarry, Jr.
(74) *Attorney, Agent, or Firm* — Nikolai & Mersereau, P.A.; C. G. Mersereau

(57) ABSTRACT

An automated trackside railed car discharge gate operating system is disclosed which can automatically unload a string of cars "on the fly" and without the need for a separate indexing system. The system includes a pair of carriage-mounted tool systems for opening/closing capstan-operated railcar gates disposed to travel along a carriage track and including visual devices that acquire and track capstans and coordinate tool orientation and operation.

8 Claims, 6 Drawing Sheets

AUTOMATED RAILCAR GATE OPERATING SYSTEM

CROSS-REFERENCED TO RELATED APPLICATIONS

This application is a continuation-in-part of application Ser. No. 12/696,229, filed Jan. 29, 2010, and that application is deemed incorporated herein by reference in its entirety.

STATEMENT REGARDING FEDERALLY SPONSORED RESEARCH OR DEVELOPMENT

Not applicable

BACKGROUND OF THE INVENTION

I. Field of the Invention

The present invention relates generally to an automated system for opening and closing bottom gates on railcars and, more particularly, relates to an automated railcar gate operating system for capstan-operated railcar gates that, in addition to automatically unloading stationary railcars, sequentially locates and opens and closes gate operating capstans of railcars on the fly as the car move along across a cargo receiving pit.

II. Related Art

Uni-Trains, many containing 100 or more cars of identical or a variety of sizes and types, have long been acknowledged as desirable and efficient carriers of bulk raw materials such as coal, iron ore, limestone, various finely divided dry bulk agricultural products including grains, etc., and liquid or dry chemicals. These cars are typically filled from above and may be emptied using a rotary car dumper in the case of coal or iron ore. Liquid bulk cargo is typically unloaded by connecting outlets to large hoses with associated pumping equipment and opening bottom drain valves.

Cars shipping bulk agricultural products, for example, however, are bottom emptied into stationary cargo-receiving pits. These cars are provided with a number of spaced bottom discharging hopper bins accessing the main storage volume of the car. These hoppers are closed by horizontal slide gates. When the hoppers are precisely positioned over fixed recessed receiving facilities beneath the railroad track, the gates are opened and the cargo discharged.

In the bottom discharge operation, a connected train engine roughly positions one end of a string of cars to be unloaded close to the unloading facility. However, train engines are not well suited for indexing or precisely positioning individual cars or even sets of cars along the track. Because of this, traditionally, train positioning devices known as railroad car indexers or movers have been built and operated at fixed stations along the tracks to more precisely position cars for unloading operations. Thus, the railcars have heretofore had to be positioned and unloaded while they were stationary and while under the control of such an indexing system.

Railroad cars having bottom discharge hopper-type bodies include spaced aligned hoppers which are closed by separate, horizontally disposed gates that are displaced laterally to open and close the bottom of each hopper by drive systems that typically include a rack and pinion mechanism operated by rotating an associated operating rod using an attached capstan. This has necessitated a separate manual operation utilizing a powered gate operator in which a key or gripper device is used to attach to and rotate each of the capstans. This function has long involved the provision of a separately supplied cantilevered gate operator device utilizing a telescoping chuck to engage a capstan of a railroad car gate. The gate operators are typically separately mounted to operate along their own gate operator platform spaced from, but associated with, a railcar indexing system. This has involved a relatively slow and labor intensive operation. The chuck must be adjusted to match the height, depth and rotational position of each capstan.

Attempts have been made to automate the opening and closing of railcar discharge doors using trackside devices mounted on moveable carriages to operate doors located near the bottom of hopper-type railcars. One such system used to address latching, hinged gates is shown in U.S. Pat. Nos. 7,063,022 and 7,178,465. Earlier attempts to automate capstan operators have heretofore not met with much success.

Thus, there remains a need to provide a fully automated bottom discharge gate operating system that addresses rotating capstan-operated bottom discharge gates in commodity carrying railcars. Such a system would be particularly advantageous if, in addition to unloading stationary railcars, it could operate to unload a string of cars into a grain receiving pit "on the fly" while the cars are moved across the pit.

SUMMARY OF THE INVENTION

By means of the present invention, there is provided an automated trackside railcar discharge gate operating system which can automatically unload a string of cars "on the fly" and without the need for a separate indexing system. The system includes a pair of carriage-mounted tool systems for opening/closing capstan-operated railcar gates disposed to travel along a carriage track and including visual devices to acquire and track capstans to coordinate tool operation.

In one embodiment, for unloading cars in adjoining consecutive receiving pits, a pair of spaced fixed-positioned camera devices are situated along the track for sequentially acquiring and transmitting coordinates of passing railcar gate capstans to the carriage-mounted tool systems. A railcar location feedback system in communication with the fixed camera devices is provided for communicating railcar positions to the fixed-position camera devices. The feedback system includes a plurality of carriage-mounted devices with deployable bogey frame engaging arms that are pushed along by the railcars as they are processed.

In an alternate embodiment, the system includes a carriage-mounted trackside moving gate opening tool system that also is equipped with a three-dimensional vision sensing system and operates in conjunction with an associated carriage-mounted, trackside, moving gate opener feedback device; and a carriage-mounted trackside moving closing tool system that is also equipped with a three-dimensional vision sensing system and operates in conjunction with an associated carriage-mounted, trackside, moving gate closer feedback device. The vision sensing systems include a camera, laser and a computing device. The system includes a central data processing or computing unit that communicates with the other system components. No fixed cameras are necessary with this embodiment.

Each of the visual devices or vision sensing systems associated with carriage-mounted tool systems includes a video camera with three-dimensional capability that operates in conjunction with a laser and a computing device for recognizing and resolving both a capstan rotational position and lateral position distance and causing the tool system to track the capstan. Each of the tool systems also includes a means for aligning a capstan operating chuck tool with the recognized capstan rotational orientation for both the opening and closing steps which can be accomplished as the capstan continues to move.

DETAILED DESCRIPTION

The following description details one or more exemplary embodiments illustrating the present invention. It should be noted that the detailed descriptions are intended by way of example only and are not intended to limit the scope of the invention in any respect. It will be further understood that the embodiments of the invention can be modified by those skilled in the art while remaining in keeping with the inventive concepts.

Figure 3:
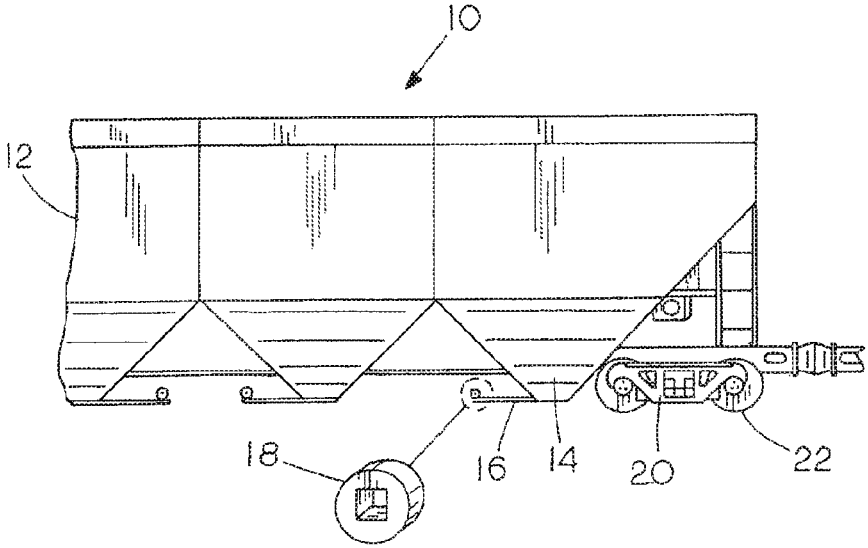
FIG. 3 is a fragmentary side elevational view of a railcar having discharge gates with which the present automated system is designed to be used.

FIG. 3 is a fragmentary view of a typical bulk cargo, bottom discharging railcar 10 of a class for which the automated trackside railcar discharge gate operating system of the present invention is designed. The car has a cargo hold 12, a plurality of discharge chutes as at 14, closed by rack and pinion operated gate members operated by rotating capstans, a portion of one of which is shown enlarged at 18. A bogey frame is shown at 20 with wheels 22.

Figure 1:
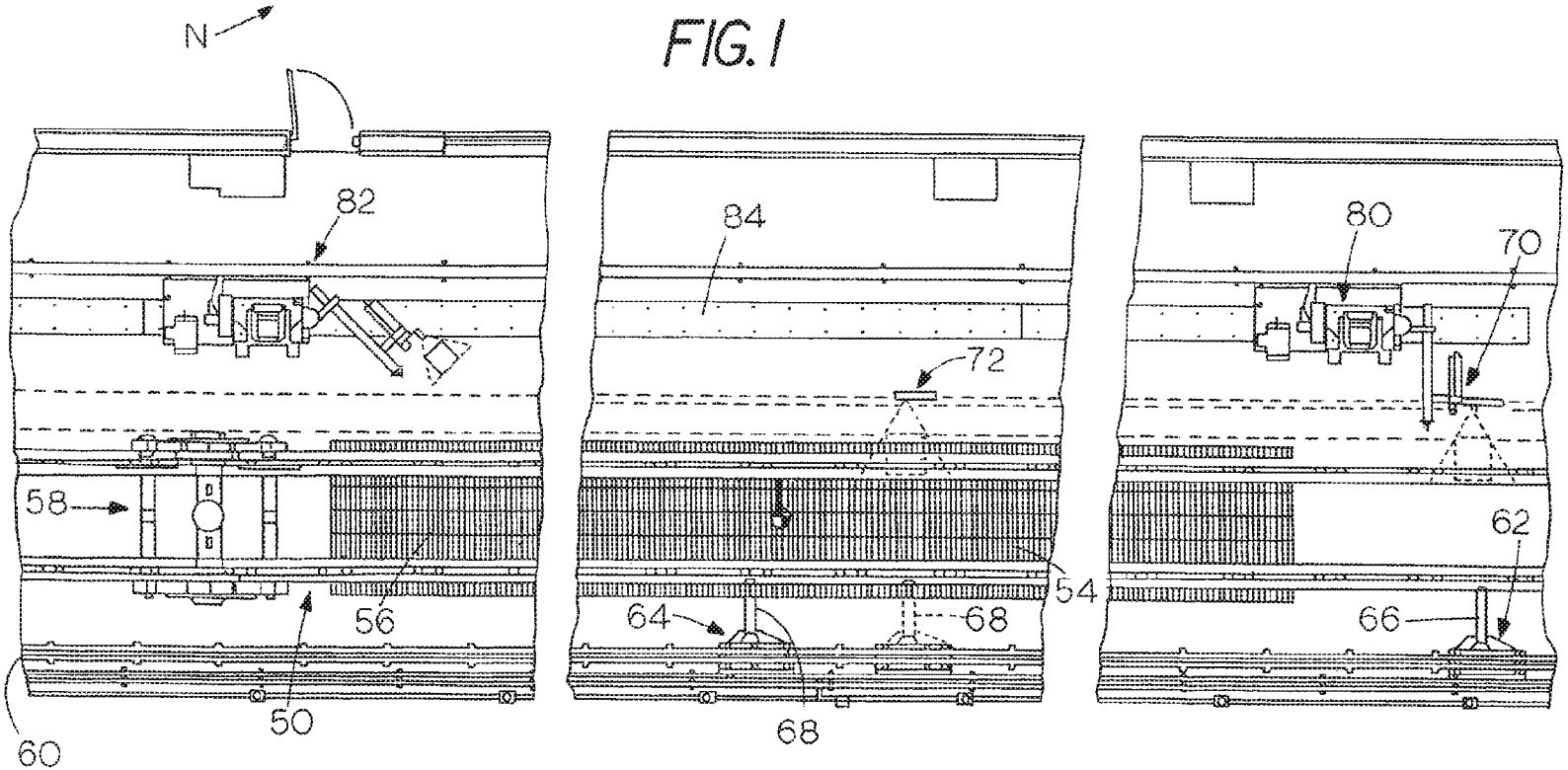
FIG. 1 is a plan layout of an automated trackside discharge gate-operating system in accordance with the invention with parts broken away for clarity.

A plan layout of one embodiment of an automated trackside discharge gate operating system in accordance with the invention is shown with parts broken away for clarity in FIG. 1. The general layout includes a main railroad track 50 that traverses over a cargo receiving area that is divided into north and south pit areas as at 54 and 56. A bogey frame is shown schematically at 58 for illustration purposes regarding railcar location, width, etc.

A gate operator feedback track 60 is located parallel to and spaced from the main track 50 on the side opposite that of the gate opening/closing system devices. The feedback track carries a plurality of feedback actuator devices, including a north actuator device 62 and a south actuator 64 (shown in two positions). For convenience, the direction north is designated as generally left to right in FIG. 1. Each actuator device includes a deployable arm as at 66 and 68 for north and south devices, respectively. The feedback track is spaced from the main track a distance that enables the actuator arms on the feedback devices to be contacted by the bogey frames of cars moving past the feedback devices when the arms are deployed. The feedback actuator devices further include motorized arm displaying actuators that rotate the corresponding arms in and out of the deployed position. The feedback actuators can be operated to move along the feedback track 60, but are designed to be moved along by contacted bogey frames when the arms are deployed.

Two fixed video camera devices, including a fixed gate-opener camera device 70 and a fixed gate-closer camera device 72, are mounted a distance apart along and spaced from the main track 50 on the side opposite the feedback track location. These devices recognize and note the coordinates of passing capstans associated with railcar discharge gates and transmit this data to mechanized carriage-mounted tool systems for opening and closing capstan-operated railcar discharge gates. These include a gate opener tool system shown generally at 80 and a gate closer tool system, generally at 82. The tool systems operate along a gate opener/closer track 84 located parallel to and spaced alongside the main track, just beyond the location of the fixed camera devices, so that the tool systems may operate to traverse and pass behind the fixed camera devices as necessary with the opener/closer tool stowed. The system 82 is shown with the tool in a rotated, stowed position.

FIGS. 2A-2D depict views of a carriage-mounted tool system similar to those shown at 80 and 82 in FIG. 1 in accordance with the invention. The tool system includes an enclosed hydraulic power unit 100 that is used to power both the linear travel of the tool system as it traverses along the simulated gate opener/closer track as at 112 and indicated by the arrow 114 in FIG. 2A. The tool system includes a telescoping capstan operating tool 102 having an outer tube 104 containing an extendable rotating chuck member 106 of a shape and size matching that of the gate-operating capstans of interest. The chuck member is operated by a motor 108 coupled to a telescoping shaft 110 carrying the chuck member 106. The motor is capable of sensing and adjusting the rotational position of the chuck member to match the observed rotational position of a corresponding capstan, as will be explained. The gate-operating tool stations further include a laser device 111 that indicates the relative extended position of the tool. A further tool actuator is provided (not shown) which combines tool extend/retract functions with tool pivot and rotation functions. Each gate-operating tool system further has a fixed 3D camera 108 mounted on the tool unit that verifies the exact location and orientation of each capstan entering its field of view to coordinate the operation of the tool with each capstan observed. One such camera that has been used successfully includes a CMOS chip optimized for 3D imaging using a laser and rapid data processing with triangulation and is available as a Smart Camera from SICK AG of Waldkirch, Germany.

Figure 2A:
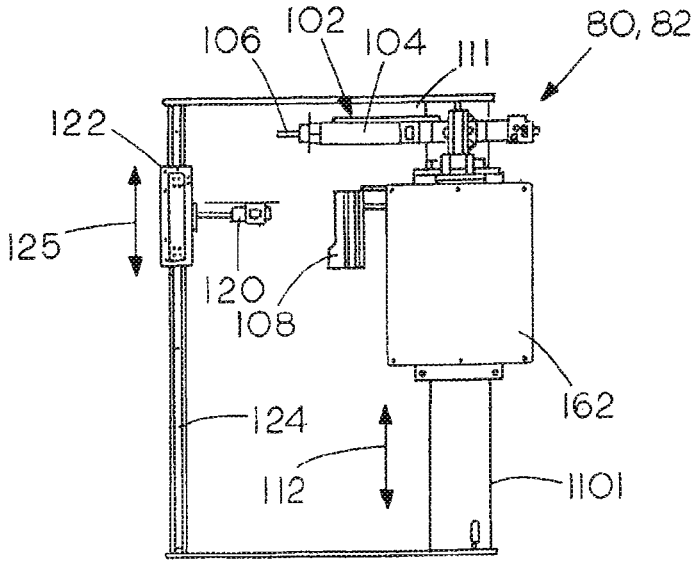
FIG. 2A is a top schematic view of a carriage-mounted tool system in accordance with the invention shown in relation to a normal capstan location.
Figure 2B:
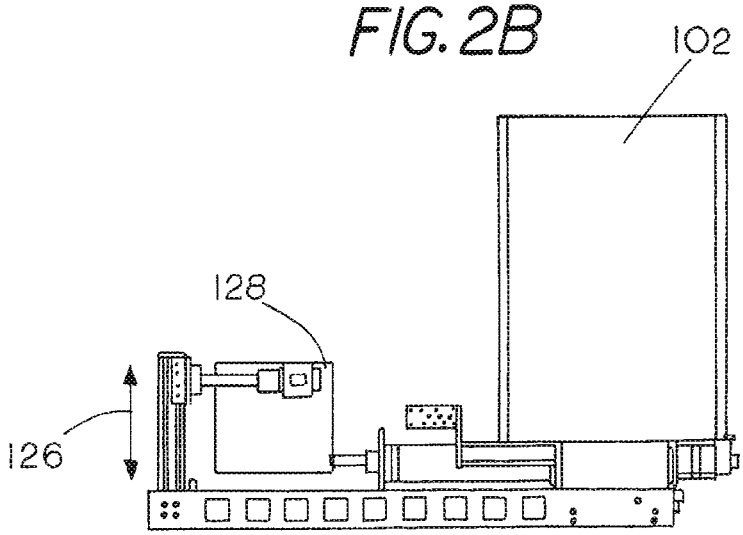
FIG. 2B is a side elevational view of the carriage-mounted tool system of FIG. 2A.
Figure 2C:
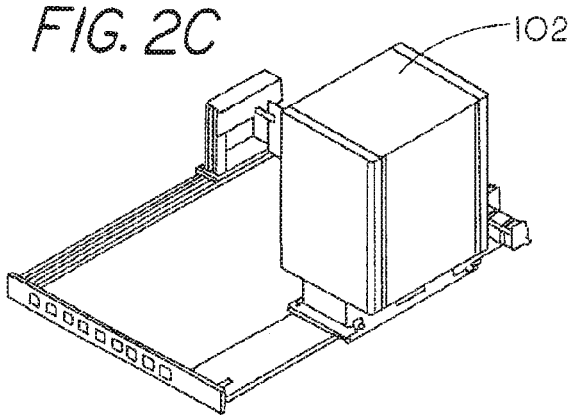
FIG. 2C is a rear perspective schematic view of the carriage-mounted tool system of FIG. 2A.
Figure 2D:
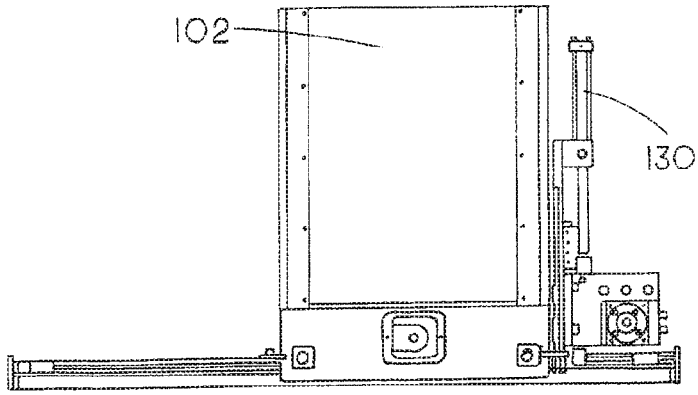
FIG. 2D is a schematic rear elevational view of the carriage-mounted tool system of FIGS. 2A-2C.

The figures further include a representation of a movable gate-operating capstan device at 120 mounted on a carriage 122 capable of traversing a track or guideway 124 or being raised and lowered as shown by arrows 125 and 126 and the location may be anywhere within, for example, box 128, shown in FIG. 2B. As shown best in FIG. 2D, a vertical cylinder is provided to adjust the height of the tool in accordance with received coordinates. The tool 102 is also capable of swinging out of the way to a retracted position, as shown for system 82 in FIG. 1. A traverse drive access cover is shown at 132.

Figure 4:
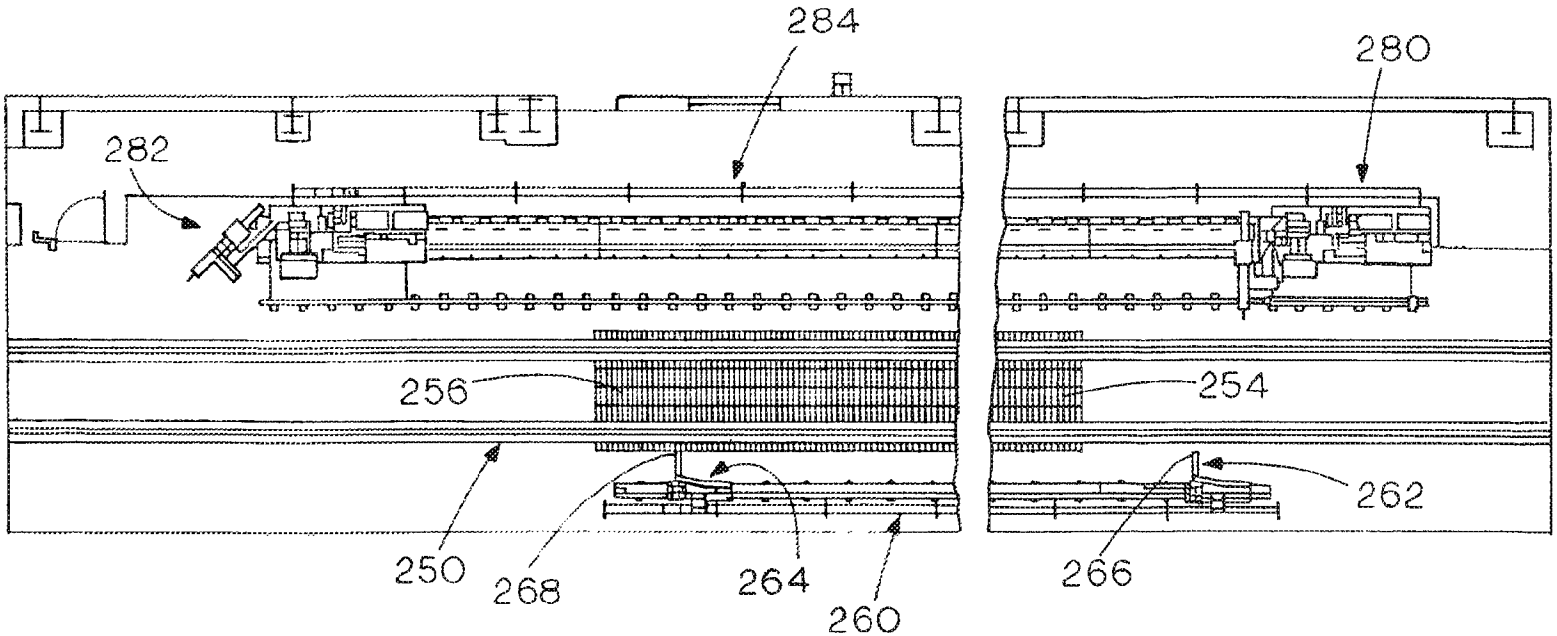
FIG. 4 is a plan layout of an alternate embodiment of the trackside discharge gate operating system of the invention broken for clarity.

A plan layout of an alternate embodiment of an automated trackside discharge gate operating system in accordance with the invention is shown with parts broken away for clarity in FIG. 4. This embodiment is similar to the embodiment previously described, however, it does not require any separate fixed cameras. As will be described, this embodiment includes two carriage-mounted trackside gate operating systems that operate in conjunction with two carriage-mounted trackside feedback actuator devices. Thus, each of the feedback actuator devices operates in conjunction with an associated gate opener or gate closer system to perform the gate opening and gate closing operations as cars are moved through a cargo receiving pit area.

The general layout includes a main railroad track 250 that traverses over a cargo receiving area that is divided into north and south pit areas as at 254 and 256. A gate operator feedback track 260 is located parallel to and spaced from the main track 250 on the side opposite that of the gate opening/closing system devices. The feedback track carries a plurality of carriage-mounted feedback actuator devices, including an opener feedback actuator device 262 and a closer feedback actuator device 264. For convenience, the direction north to south is designated as the direction of railcar travel and is generally right to left in FIG. 4.

As with the previous embodiment, each feedback actuator device includes a deployable arm as at 266 and 268 for the device associated with opening and closing of the car gates, respectively. The feedback track is spaced from the main track a distance that enables the actuator arms on the feedback devices to be contacted by the bogey frames of cars moving past the feedback devices when the arms are deployed. The feedback actuator devices further include arm deploying actuators that rotate the corresponding arms in and out of the deployed position. These are preferably hydraulic or pneumatic cylinders. The feedback actuators are operated to move along the feedback track 260 for positioning to detect the next railcar to be unloaded or closed, and are designed to be moved along by contacted bogey frames when the arms are deployed.

Figure 5:
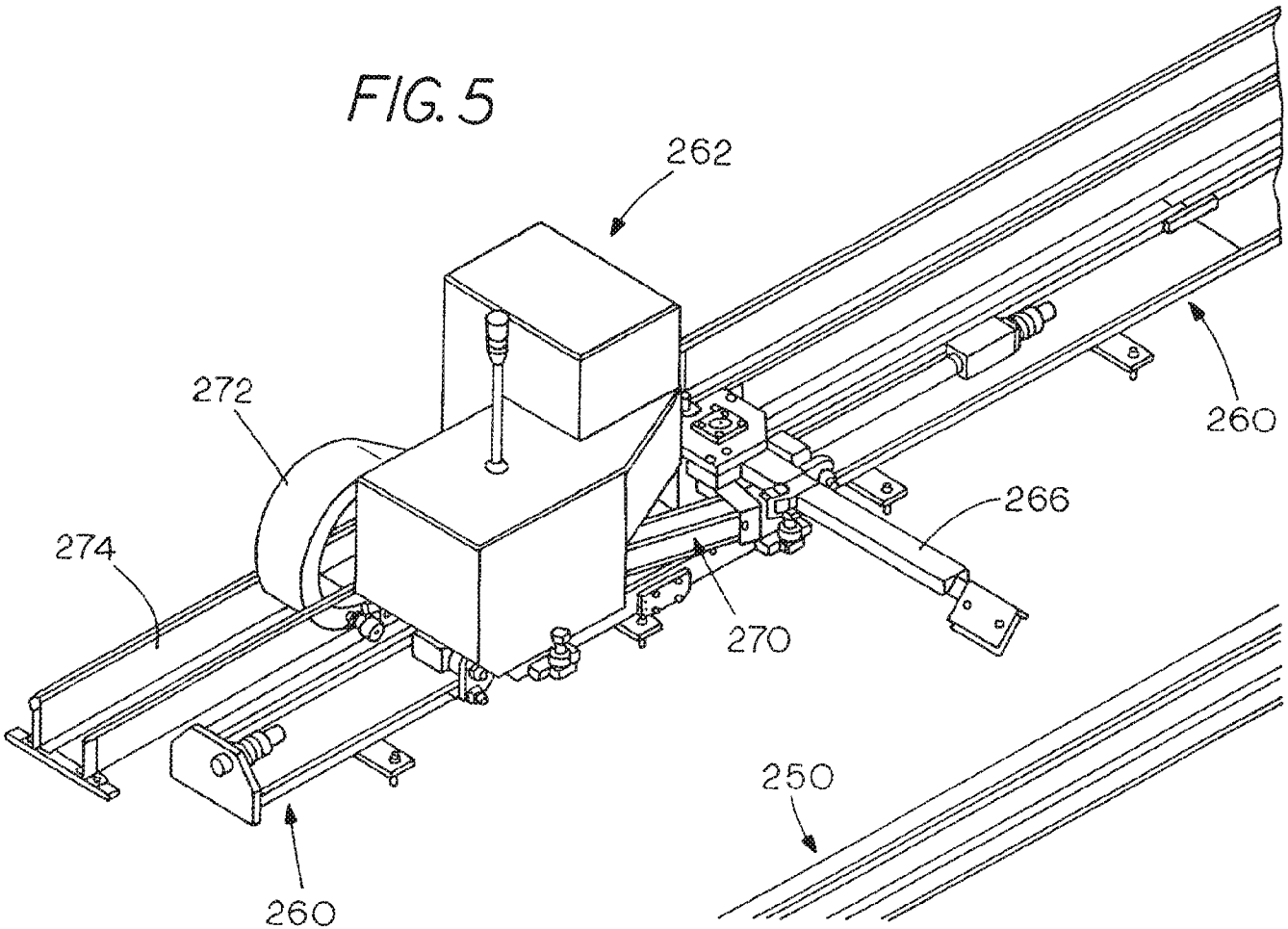
FIG. 5 is an enlarged front perspective view of a carriage-mounted gate opener or gate closer feedback actuator device associated with the invention.

FIG. 5 depicts an enlarged front perspective view of a carriage-mounted gate opener or gate closer feedback actuator device 262 with arm 266 deployed to engage the bogey frame of a railcar moving past. The arm 266 is deployed and retracted using an actuator 270 which is shown as a pneumatic cylinder. Power is supplied to the carriage-mounted feedback actuator device 270 using a flexible lead system 272 which operates in a parallel guide trough 274. While only one feedback actuator device is shown in the drawing, it will be appreciated that both devices are identical.

Figure 6:
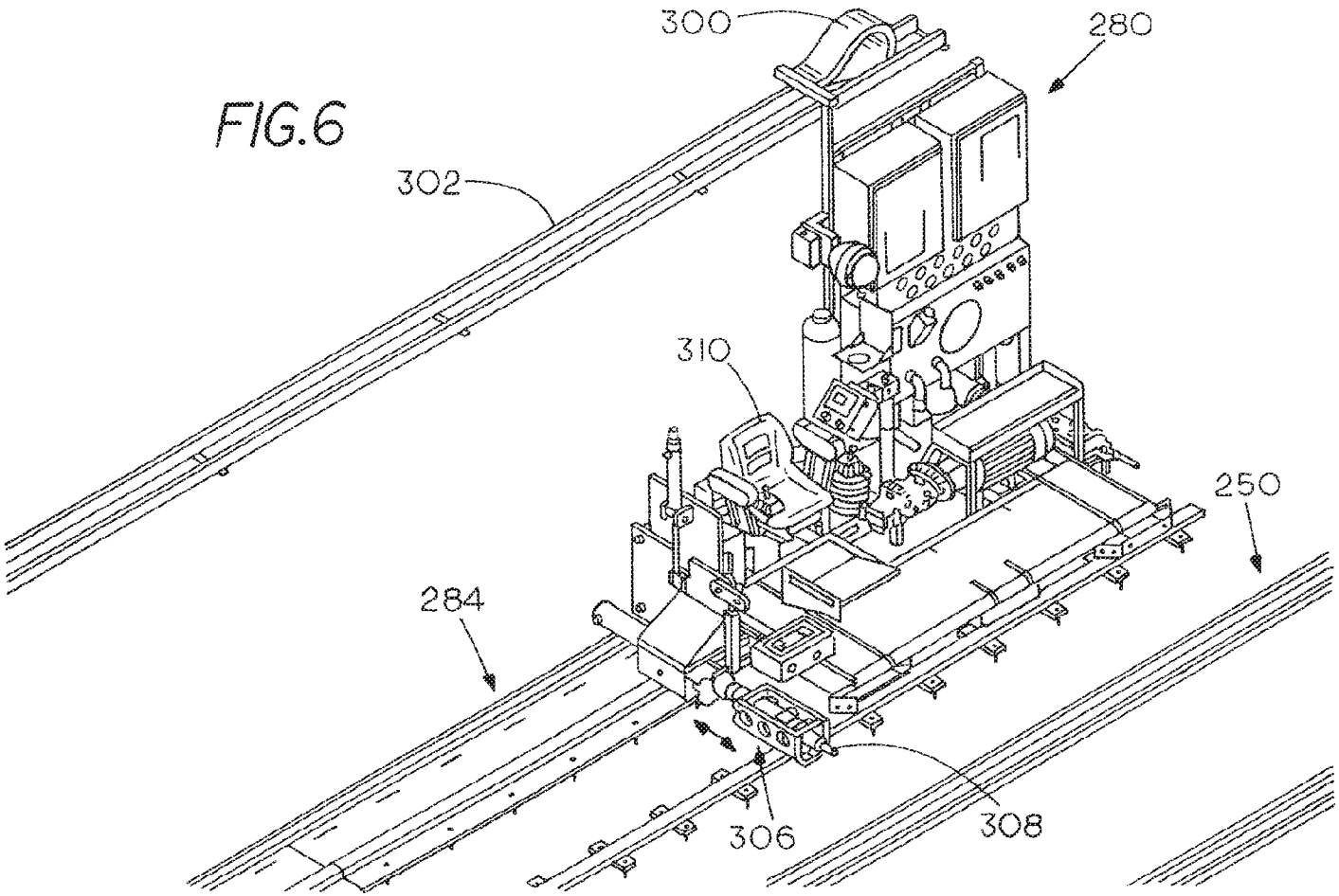
FIG. 6 is an enlarged front perspective view of a carriage-mounted gate opening or gate closing tool system in accordance with invention.

FIG. 6 is an enlarged front perspective view of one of a duplicate pair of carriage-mounted gate operating tool systems which include a carriage-mounted gate opening and a carriage-mounted gate closing tool system in accordance with the invention. Thus, the gate opening tool system 280 is identical to the gate closing device 282 as shown in FIG. 4. The carriage-mounted tool system includes electrical and hydraulic systems supplied by a flexible lead 300 that rides in a guide 302. The system carries a three-dimensional sensing camera 304 and a telescoping capstan-operating tool 306 with extendable chuck member 308. The chuck member is one of a shape or size to accommodate rotating gate-operated capstans of interest and is replaceable as needed. An operator's chair that would be used for manual operation or during maintenance is shown at 310.

It should be noted that the detection system of the carriage-mounted gate opening or gate closing systems that includes the three-dimensional sensor, further includes a railcar reader which reads the Umler™ barcode on each railcar which enables access to a great deal of information concerning each individual railcar, including such information as axle count and axle spacing, gate count and other information pertaining to the dimensional characteristics of that car. The information, along with other feedback information, is communicated to a central data processing unit or computer which can communicate with both the gate opening and gate closing tool systems and control operation of the automated system. The relative extended position of the capstan-operating tool 306 may be determined using a wire draw encoder in a well known manner.

In operation, the embodiments are generally similar, but differences exist. Thus, the carriage-mounted railcar gate opener/closer carriage assembly tool systems may be operated in conjunction with fixed camera devices and feedback system or using a feedback system that operates without the need for fixed camera devices. Typical sequences of operations for the two systems are enumerated in the following lists of steps, including a system with fixed camera devices followed by one without fixed cameras.

To unload a string of cars, initially, with reference to the directions of FIG. 1, railcars are spotted using a locomotive such that the coupler between the first and second car is centered between the south pit 56 and north pit 54. The first two cars may be addressed and unloaded manually according to steps 2 and 3.

1. With two railcars over the pit area, the operator engages the north feedback device 62 to the south side of the south truck of the third car deploying the arm 66.

2. The operator manually opens and closes the north car with the railcar opener. Then the South car is manually opened and closed with the railcar closer. This also allows the operator to insure that the machines are in optimal operating condition.

3. The operator returns the machines to the start position.

4. With the first two cars empty and closed, the locomotive will begin moving cars south at a maximum speed of about 40 feet (12.2 m) per minute (8 inches or 20.3 cm per second).

5. The north feedback device 62 is pushed along by the third car providing pulses that are transmitted to the fixed camera 70.

6. The third railcar passes a car reader and information including the number of capstans along with the distance between trucks for the railcar is recorded.

7. When the fixed camera 70 recognizes a capstan square hole, the coordinates are sent to the railcar gate opener tool system 80.

8. The railcar gate opener tool system 80 traverses north while the railcars move south. It extends its vision camera while raising the tool to match the coordinates received from the fixed camera and scans the car as it moves by.

9. When the railcar opener dynamic camera recognizes a square hole in a capstan, it will track the capstan target and insert the tool.

10. The gate opener will first turn the capstan counterclockwise to open the gate. If the gate won't rotate open, it will be turned clockwise to open the gate until the motor stalls. While the gate opener is opening the gate, the fixed camera 60 has scanned and logged the coordinates of the next gate capstan.

11. If the current capstan is not the last capstan for that railcar, the gate opener retracts its tool and returns to step 7. If the current capstan is the last, then step 12 becomes active.

12. While the gate opener tool is inserted in the last gate after it is opened, the north feedback device will transfer. Using the distance between the trucks noted earlier from the database along with the then current position of the gate opener tool system 80, a position to again deploy the north feedback device 62 is calculated.

13. When the north feedback device 62 reaches the target position, it stops and deploys its arm 66. Then the gate opener retracts from the last capstan and moves rapidly north to the initial traverse position.

14. Step 6 becomes active. This process (steps 6-13) repeats until all cars are emptied.

During the unloading process, the gate closing operation is also underway and proceeds in the sequence described next.

1. The south feedback device 64 waits at its full north position. When the north feedback device is pushed to a location approximately 18 feet from the south by the third railcar, the south feedback arm 68 will deploy. In this manner, the arm 68 will make contact with the south side of the north truck of the third railcar.

2. The railcar gate closer tool system then traverses north while the railcars move south. It extends its vision camera while raising the tool to match the coordinates received earlier from the fixed camera 70 and scans the car as it moves by.

3. When the railcar gate closer tool system dynamic camera recognizes the square hole in the capstan, it will track the target and insert the tool.

4. The gate closer will turn the capstan to rotate in the opposite direction from that in which the gate was opened until the motor stalls.

5. If the then current capstan is not the last, the gate opener retracts its tool and returns to step 2. If the current capstan is the last of the current railcar, then step 6, below, becomes active. If the then current capstan is the last capstan of the last railcar, step 9 becomes active.

6. While the gate closer tool is inserted in the last gate after it is closed, the South feedback device 64 will transfer. Using the distance between the trucks noted earlier from the database along with the current position of the gate closer, a new position to deploy the south feedback device 64 is calculated.

7. When the south feedback device 64 reaches the new target position, it stops and deploys its arm 68. Meanwhile, the gate closer tool is retracted from the capstan and moves rapidly north to return to the initial traverse position.

8. Step 2 becomes active. This process sequence (steps 2-8) repeats until the closer inserts its tool into the last capstan of the second to last railcar.

9. With the opener inserted in the last capstan of the last railcar, the south feedback device 64 will stow its arm 68 and return to its full north position.

10. With the last gate closed, the gate closer tool is retracted from the capstan and the gate closer tool system moves rapidly north to the initial traverse position.

11. The gate opener, gate closer systems, north/south feedback devices go to their home positions.

The operation of the alternate embodiment that does not require fixed cameras differs somewhat from the sequence described above and will be described.

Thus, in startup, after manually unloading the first two cars and advancing the third car as it moves through the facility, beginning with step 5, the opening sequence of the operation differs:

5. The opener actuation feedback device is pushed along by the first bogey frame of the third car providing pulses that are transmitted to the central computing device and the gate opening tool system computer.

6. The car reader on the gate opening tool system reads the Umler™ code and accesses information regarding railcar, including axle distances, dimensions and number of gates and transmits information to the central computing device which communicates with computing devices on both the gate opening tool system and the gate closing tool system.

7. With the gate opening tool system stationary, the three-dimensional sensing system recognizes a capstan square hole and notes the coordinates to the computing device which causes the tool to be raised or lowered to match the coordinates. The gate opening tool system then tracks the capstan target and inserts the tool.

8. The gate opener will first turn the capstan counterclockwise to open the gate. If the gate won't rotate open, it will be turned clockwise to open the gate until the motor stalls.

9. If the current capstan is not the last capstan for that railcar, the gate opener retracts its tool and returns to step 7. If the current capstan is the last, then step 10 becomes active.

10. While the gate opener tool is inserted in the last gate after it is opened, the gate opener feedback actuator device will transfer. Using the distance between the trucks noted earlier from the database along with the then current position of the gate opener tool system 280, a position to again deploy the gate opener feedback device 262 is calculated.

11. When the gate opener feedback device 262 reaches the target position, it stops and deploys its arm 266. Then the gate opener tool system retracts from the last capstan and moves rapidly north to the initial traverse position.

12. Step 6 again becomes active. This process (steps 6-11) repeats until all cars are emptied.

As with the earlier sequence, during the unloading process, the gate closing operation is also underway and proceeds in the sequence described next.

1. The gate closer feedback actuator device 264 waits at its full north position. When the gate opener feedback device is pushed to a location approximately 18 feet from the south by the third railcar, the south feedback arm 268 will deploy. In this manner, the aim 268 will make contact with the south side of the north truck of the third railcar.

2. The railcar gate closer tool system then traverses north while the railcars move south. It extends its vision camera while raising the tool to match sensed coordinates communicated from the central processor.

3. When the railcar gate closer tool system dynamic camera recognizes the square hole in the capstan, it will track the target and insert the tool.

4. The gate closer will turn the capstan to rotate in the opposite direction from that in which the gate was opened until the motor stalls.

5. If the then current capstan is not the last, the gate opener retracts its tool and returns to step 2. If the current capstan is the last of the current railcar, then step 6, below, becomes active. If the then current capstan is the last capstan of the last railcar, step 9 becomes active.

6. While the gate closer tool is inserted in the last gate after it is closed, the gate closer feedback device 264 will transfer. Using the distance between the trucks noted earlier from the database along with the current position of the gate closer, a new position to deploy the gate closer feedback device 264 is calculated.

7. When the gate closer feedback device 264 reaches the new target position, it stops and deploys its arm 268. Meanwhile, the gate closer tool is retracted from the capstan and moves rapidly north to return to the initial traverse position.

8. Step 2 becomes active. This process sequence (steps 2-8) repeats until the closer inserts its tool into the last capstan of the second to last railcar.

9. With the opener inserted in the last capstan of the last railcar, the gate closer feedback device 264 will stow its arm 268 and return to its full north position.

10. With the last gate closed, the gate closer tool is retracted from the capstan and the gate closer tool system moves rapidly north to the initial traverse position.

11. The gate opener, gate closer systems, opener/closer feedback devices go to their home positions.

While the operation has been described with particular regard to unloading moving railcar stock, it will be appreciated that the system can also be used to address stationary railcars.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An automated trackside railcar discharge gate operating system comprising:

(a) a railcar gate opening and closing arrangement comprising a pair of automated carriage-mounted capstan-operating tool systems for opening/closing capstan-operated railcar gates, said tool systems being disposed to travel along a carriage track and open and/or close moving capstan-operated railcar gates on moving railcars, said tool systems including systems to acquire, transmit and receive data, including data regarding capstan coordinates for each car to be processed, a capstan-operating tool and visual device to acquire and track capstans to coordinate tool operation;

(b) a railcar location feedback system separate from said railcar gate opening and closing arrangement and comprising a pair of carriage-mounted trackside feedback devices to coordinate railcar opening and closing operations, respectively, for detecting, being moved by, and communicating the location and movement of railcars to be processed, said device being disposed to travel along a feedback track; and (c) a central data processor and control device that communicates with and coordinates operation of said tool systems and said feedback devices.

2. An automated system as in claim 1 including a device for reading railcar codes.

3. An automated system as in claim 1 wherein each said carriage-mounted trackside tool system operates in conjunction with a corresponding feedback device.

4. An automated system as in claim 1 wherein each of said vision devices of said tool systems includes a video camera with three-dimensional capability for recognizing a capstan height rotational position and lateral distance position a computer that enables said tool system to track said capstan.

5. An automated system as in claim 1 wherein said tool systems include means for aligning a corresponding capstan operating tool chuck with a recognized capstan rotational orientation.

6. An automated system as in claim 4 wherein said tool systems include means for aligning a corresponding capstan operating tool chuck with a recognized capstan rotational orientation.

7. An automated system as in claim 1 wherein each of said feedback device includes a deployable bogey frame engaging arm that pushed along by a railcar when it is deployed.

8. An automated system as in claim 1 wherein each of said feedback devices includes means for communicating required car locations and movement to said control data processor control.

* * * * *